United States Patent [19]

Tesch

[11] Patent Number: 4,998,309

[45] Date of Patent: Mar. 12, 1991

[54] HEALTH PILLOW

[76] Inventor: Günter Tesch, Avenue Jean-Marie-Musy 15, CH-1700 Fribourg, Switzerland

[21] Appl. No.: 515,342

[22] Filed: Apr. 30, 1990

Related U.S. Application Data

[63] Continuation of Ser. No. 272,325, Nov. 17, 1988, abandoned.

[30] Foreign Application Priority Data

Nov. 19, 1987 [DE] Fed. Rep. of Germany ..... 3739215

[51] Int. Cl.[5] ..... A47G 9/00

[52] U.S. Cl. ..... 5/434; 5/436; 5/442

[58] Field of Search ..... 5/434, 436, 437, 441, 5/442

[56] References Cited

U.S. PATENT DOCUMENTS

| | | | |
|---|---|---|---|
| 1,212,515 | 1/1917 | Leavitt | 5/436 |
| 1,285,421 | 11/1918 | Seidler | 5/436 |
| 3,312,987 | 4/1967 | Emery . | |
| 3,757,365 | 9/1973 | Kretchmer . | |
| 4,060,863 | 12/1977 | Craig | 5/436 X |
| 4,618,531 | 10/1986 | Marcus | 428/280 X |
| 4,887,326 | 12/1989 | O'Brien et al. | 5/442 |

FOREIGN PATENT DOCUMENTS

| | | | |
|---|---|---|---|
| 419398 | 1/1970 | Australia . | |
| 0013427 | 7/1980 | European Pat. Off. . | |
| 305694 | 1/1933 | United Kingdom | 5/441 |
| 414131 | 8/1934 | United Kingdom | 5/434 |
| 610415 | 10/1948 | United Kingdom . | |

*Primary Examiner*—Michael F. Trettel
*Attorney, Agent, or Firm*—Bacon & Thomas

[57] ABSTRACT

A pillow with a cover and a filling is described, the pillow having a general rectangular shape and being characterized in that the cover (2) comprises an essentially unstretchable fabric, it has in the empty state, a flat generally rectangular configuration comprising, beginning with a rectangle with a side ratio of about 3:4, a first longer lateral edge containing a centered, inwardly directed curvature (4), while the other longer lateral edge has a centered, outwardly directed curvature (5); the filling (3) consists of essentially spherical fiber aggregates formed by spherically intertwined fibers and/or filaments, and the fiber aggregates filled into the cover (2) have a pile density amounting to 3 to 7 times the apparent density of the fiber aggregates in the uncompressed state outside the cover (2).

The pillow of this configuration may be produced in a simple manner, is readily adapted to the needs of the user and adequately supports the head of the user both in the supine and the lateral position.

17 Claims, 3 Drawing Sheets

HEALTH PILLOW

This application is a continuation of application Ser. No. 07/272,325, filed Nov. 17, 1988, now abandoned.

FIELD OF THE INVENTION

This invention relates to a pillow, in particular a health pillow with a cover and a filling.

BACKGROUND OF THE INVENTION

In most cases they have rectangular base pillow configurations; occasionally the corners of a rectangular pillow are rounded off.

There are also pillows, in particular health pillows with significantly different configurations. Thus for example, a triangular pillow is described in DE-U-8.405.166, which contains in its center a triangular trough. If a person lies on his back, his head rests essentially in the trough, while his neck is supported by a lateral roll, i.e. a tubular-like structure. If the person lies in the so-called lateral position, his head will rest on one of the two other lateral rolls.

Pillows that are essentially rectangular are further known, which comprise, in one longitudinal edge, a harder tubular-like structure serving as a neck rest. Several such tubular-like portions may be provided.

All of these pillows are difficult to manufacture, as in addition to a peripheral seam, additional seams must be applied and the chambers created must be filled with different materials and/or to different degrees.

Furthermore, in view of their configuration these pillows cannot be adapted to the wishes of different persons, so that pillows of different shapes must be manufactured and marketed simultaneously. If a particular pillow is purchased and is not satisfactory, another one must be bought.

Pillows, in particular health pillows, contain significantly different fillings. Pillow fillings of natural substances, such as down, feathers, horse hair or the like, have long been known. However, these have the severe disadvantage that the filler components shift easily when a head rests on the pillow. The filler components are readily displaced under the head and the head soon comes to rest between the filler components, i.e., essentially adjacent to the components of the filling.

The latter is also true for a pillow made in the conventional manner and containing fiber aggregates, such as described in EP-A-0.203.469, as the filler. The fiber aggregates described therein are strongly siliconized and therefore slide easily upon each other. In particular, in pillows of a conventional form, this further results in that the fiber aggregates are forced out of the head rest area.

SUMMARY OF THE INVENTION

It is a object of the invention to provide a pillow of the aforedescribed general type, which is simple to produce and which may be readily adapted to the needs of the user, while offering adequate support for the head of the user, even in a lateral position.

This object is attained in a surprising manner by a pillow (1) having an overall general rectangular configuration and cover (2) and a filling (3). In the case of the pillow according to the invention the cover (2) comprises an essentially unstretching fabric; the cover (2) has in the empty state a flat shape that comprises a generally rectangular-like configuration with longer and shorter lateral sides with a ratio of sides of about 3:4. And, a first longer lateral edge curving inwardly in the center, while the other longer lateral edge curves outward. Furthermore, the four corners formed by the lateral edges may be rounded.

The filling of the pillow comprises essentially spherical fiber aggregates, formed by spherically intertwined fibers and/or filaments. The fiber aggregates filled into the cover have a pile density corresponding to 3 to 7 times the apparent density of the fiber aggregates in the uncompressed state.

It was discovered with different persons that when they change their position in bed while asleep, the pillow always remains in a certain head-shoulder area of the user. If the user is in the so-called supine position, his head is resting essentially in the center of the pillow. The shoulders then abut the inwardly curved lateral edge, without resting on the pillow. If the user turns into one of the two lateral positions, the lower shoulder comes to rest in the curve of the aforementioned lateral edge. This is either because the user does not alter his position relative to the pillow but merely turns, or because the user entrains the pillow in his movement. Upon a return into the supine position, the pillow again aligns itself so that the user will again rest with his shoulders against said lateral edge.

The latter may occur when the shoulders "engage" the inwardly directed curvature, thereby entraining the pillow. If the shoulder moves out of this curvature, the center of the pillow will be under the head. The intention here is to provide a support for the head, both in the supine and the lateral position, while the shoulders are always resting on the bed itself.

The relationship between the shape of the pillow and the filling, which is essential for the invention, results from the following:

If the head applies pressure to the pillow, the fiber aggregates are compressed in the direction of the pressure and a small part of the fiber aggregates are displaced transversely to the direction of pressure. As the pillow has a certain configuration and also is filled in a relatively plump manner with fiber aggregates, the fiber aggregates displaced to one side cannot escape too far, and the pillow supports the head well. A pool is formed for the head, in which it is supported over a wide area. The pressure is thereby distributed uniformly, which leads to better and more comfortable sleep. The sleeping person is resting more quietly, whereby a smaller pillow is made sufficient, as it always remains under the head.

When the load is removed from the pillow, the fiber aggregates recover and the displaced fiber aggregates are returned into their initial position, so that following the complete relief of the pillow, it returns into its initial state.

Advantageously, the cover of the pillow has a filling volume of 5 to 9 $dm^3$, preferably about 7 $dm^3$.

The fiber aggregates filled into the cover has a pile density corresponding to 3 to 7 times the apparent density of the fiber aggregates in the uncompressed state. A pile weight of 200 to 350 g is adequate.

Depending on the body size and the sleeping habits of the user, the pillow is filled with more or less of the fiber aggregates. The volume of the filling material may be adjusted by means of an opening provided in the seam of the cover, which may be opened and closed for example with a zipper or the like.

Due to the specific configuration of the cover and the relatively high pile density, the pillow remains very firm.

In view of its low weight, its relatively small volume and the possibility of further compressing the entire pillow, it is highly suitable for taking along when travelling.

Further details and advantages of the invention will become apparent from the appended claims and the examples of embodiment described below with reference to the drawing.

DETAILED DESCRIPTION OF THE INVENTION

A health pillow 1 consists essentially of a cover 2 made of an essentially nonstretching fabric, such as, for example, a preferably dense cotton, and a filling 3 of essentially spherical fiber aggregates. The fiber aggregates of the filling 3 are shown in the four sectional views (FIGS. 2 to 5) by shading only.

Figure 1:
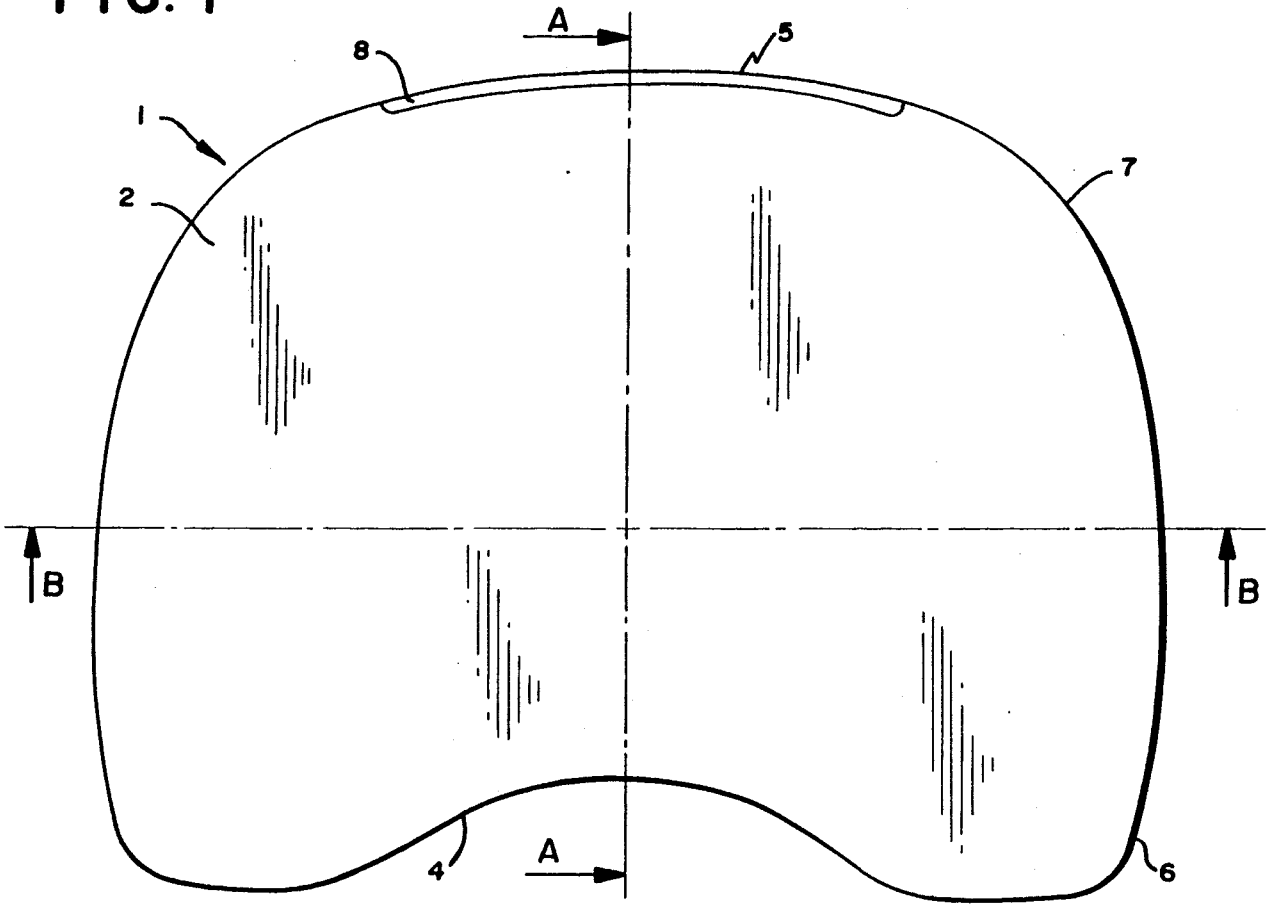
FIG. 1 shows an unfilled, flat pillow cover in a top elevation.

The pillow is actually formed from two covers 2, each of which has the form represented in FIG. 1. The fold over seam is not shown in FIG. 1. The area of each such cover (without the seam) in the case of pillow 1 is 1210 $cm^2$. In the filled state the pillow 1 has a volume of 7 $dm^3$.

This area may be described as generally rectangular in shape with a ratio of shorter to longer lateral sides of about 3:4. A first longer lateral edge has a centered, inwardly directed curvature 4, while the other longer side has a centered, outwardly directed curvature 5. The largest longitudinal (see the axis B—B in FIG. 1) extent in empty cover 2 may be 30 to 50 cm; and according to a preferred embodiment, about 40 cm.

The narrowest width of the cover 2 is centered (axis A—A in FIG. 1) and corresponds to about $\frac{2}{3}$ of the largest length of the cover 2, preferably approximately 29 cm.

In the area of this narrowest width of the cover 2, i.e., on the axis A—A, are located both the summit of the inwardly directed curvature 4 of the first longer lateral edge and the summit of the second longer lateral edge.

The summit of the inwardly directed curvature 4 of the first longer lateral edge of the cover 2 is spaced apart from the imaginary lateral edge of the rectangle by a distance corresponding approximately to 1/10 of the greatest length of the pillow 1, i.e., here about 4 cm.

The summit of the outwardly directed curvature 5 of the second longer lateral edge of the cover 2 spaced apart inwardly from the imaginary lateral edge of the rectangle by a distance corresponding to about 1/10 of the largest width of the pillow 1, i.e., here approximately 3 cm. This results in a maximum width of about 33 cm.

The radius of the inwardly directed curvature 4 of the first longer lateral edge of the cover 2 corresponds in the summit of this curvature to 3/10 to 4/10 of the greatest length of the cover 2, while the radius of the outwardly directed curvature 5 of the second longer lateral edge is larger than the greatest length, i.e., greater than 40 cm, and the amount in the preferred embodiment shown is to about 60 cm.

All four corners 6 and 7 of this area are rounded, but their radii are significantly different.

The radius of the rounded corners 7 of the cover 2 between the outwardly curved second larger lateral edge 5 and one shorter lateral edge of the cover 2 amounts to $\frac{1}{4}$ to $\frac{1}{3}$ of the greatest length of the pillow 1, i.e., between 10 and 13 cm, while the radius of the rounded corners 6 of the cover 2 between the inwardly curved first longer lateral edge and one shorter lateral edge of the cover 2 amounts to between 1/10 and 1/20 of the greatest length of the pillow, i.e., between 2 and 4 cm.

Altogether the periphery of the cover 2 of the pillow 1, with the exception of the inwardly directed curvature 4, is curved outward everywhere to a greater or lesser extent.

The dimensions preferred here yield a filling volume of about 7 $dm^3$. When the pillow 1 is filled, obviously it will have different dimensions due to the expansion of the previously flat cover 2.

The fabric of the cotton material used in this case has a weight by square meter of 125 $g/m^2$. The cover 2, which consists of two halves, thus has a weight of about 35 g. The fabric has 30 filaments in the warp direction per cm and 28 filaments per cm in the weft direction, with all of the filaments having a yarn fineness of 50 nm. The air permeability of the fabric is 126.5 $dm^3/dm^2$ per sec. The tearing strength in the warp direction is 71.9 N/cm and 62.4 N/cm in the weft direction. The breaking elongation is 9% in the warp direction and 28% in the weft direction.

The fabric thus may be designated essentially nonstretching.

The spherical fiber aggregates used in the pillow 1 in the aforedescribed preferred embodiments have outside the pillow cover 2 in the uncompressed state an apparent density of 8.6 $g/dm^3$. If the pillow 1 is filled with 210 g of fiber aggregates, an apparent density of the fiber aggregates within the pillow 1 of 30 $g/dm^3$ is obtained, thus corresponding to 3.5 times the apparent density of the uncompressed fibers not filled into the pillow.

However, in the pillow 1 the fiber aggregates may also have an apparent density of about 50 $g/dm^3$, which corresponds to a fill weight of 350 g and to 6 times the apparent density of the uncompressed fibers not filled into a pillow.

The individual fiber aggregates have a mean width of 4.5 mm, a mean length of 6.4 mm and a mean thickness of 3.5 mm, with the individual fiber aggregates being measured in their three dimensions. The individual fiber aggregates used here have a density of 0.042 $g/cm^3$. Both between the pile fiber aggregates and in the aggregates themselves therefore relatively much air space is present.

Figure 2:
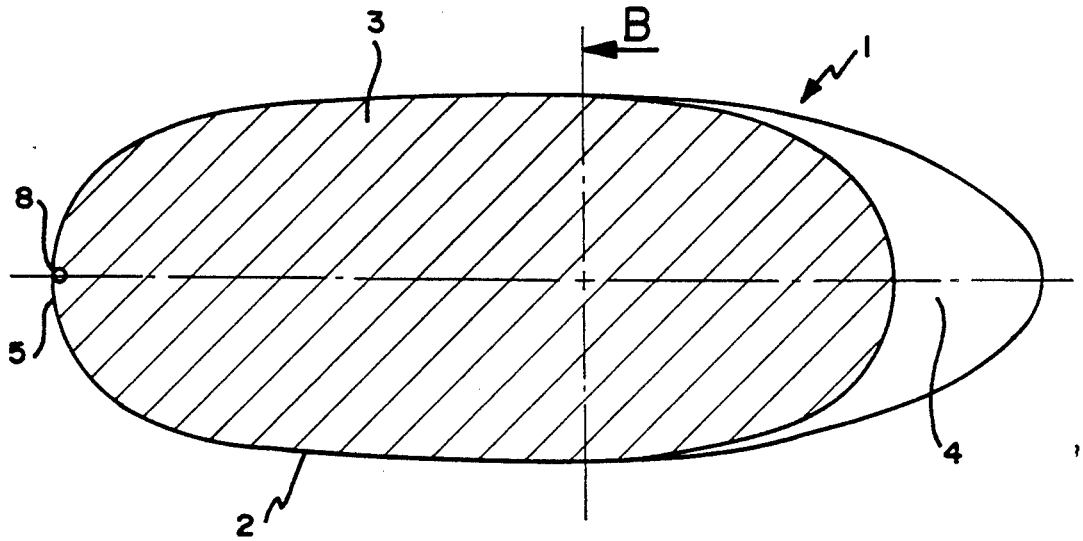
FIG. 2 shows a section through a filled, uncompressed pillow on the line A—A according to FIGS. 1 and 4.
Figure 3:
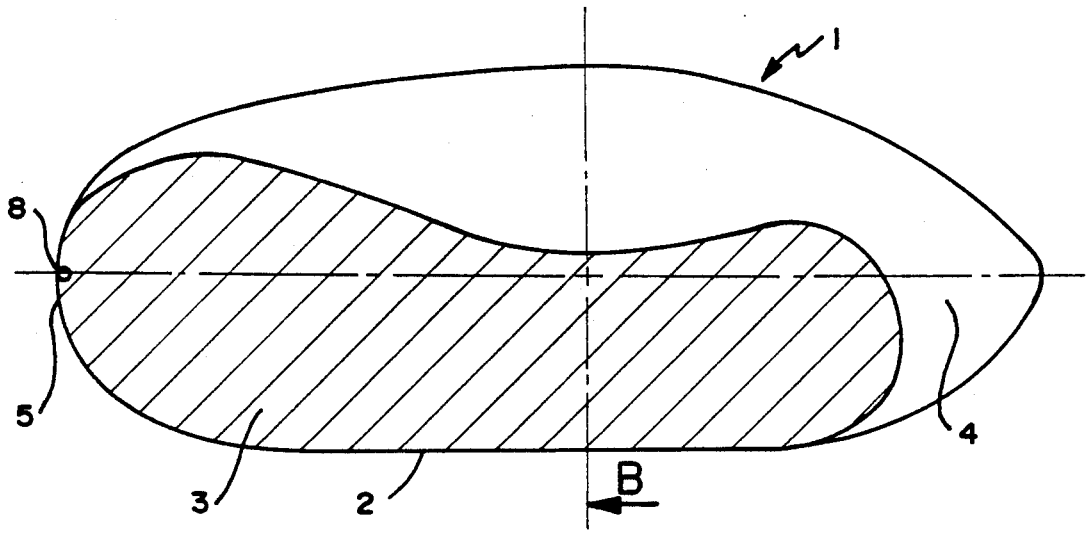
FIG. 3 shows a section through a filled, compressed pillow on the line A—A according to FIGS. 1 and 5.

The fill volume within the cover 2 of the pillow 1 may be altered by the user himself according to his wishes. For this, a zipper 8 is provided in the summit area of the outwardly directed curvature 5. This is also indicated in FIGS. 2 and 3. After the zipper is opened, fiber aggregates may be either removed or added. The fibers are handled very simply, in contrast to down or feathers, as the individual fiber aggregates are attached to each other by interhooking fibers, which may be readily separated from each other.

This condition is also utilized if the pillow should become somewhat depressed after a certain period of time, as the fiber aggregate filling can always be loosened up in a simple manner. It is usually sufficient to slightly shake the pillow 1, particularly if only the outward appearance of the pillow 1 is affected.

The fundamental process for the production of the fiber aggregates used is described for example in DE-A-2 301 913, EP-A-0.013.427 or EP-A-0.203.469. The fiber aggregates used here are made and marketed by the Fabromont Co., CH-3185, Schmitten, under the trademark "SCHLAFKUGELN". These fiber aggregates are made of intertwined fibers and/or filaments and consist of synthetic fibers and/or wool fibers.

Figure 4:
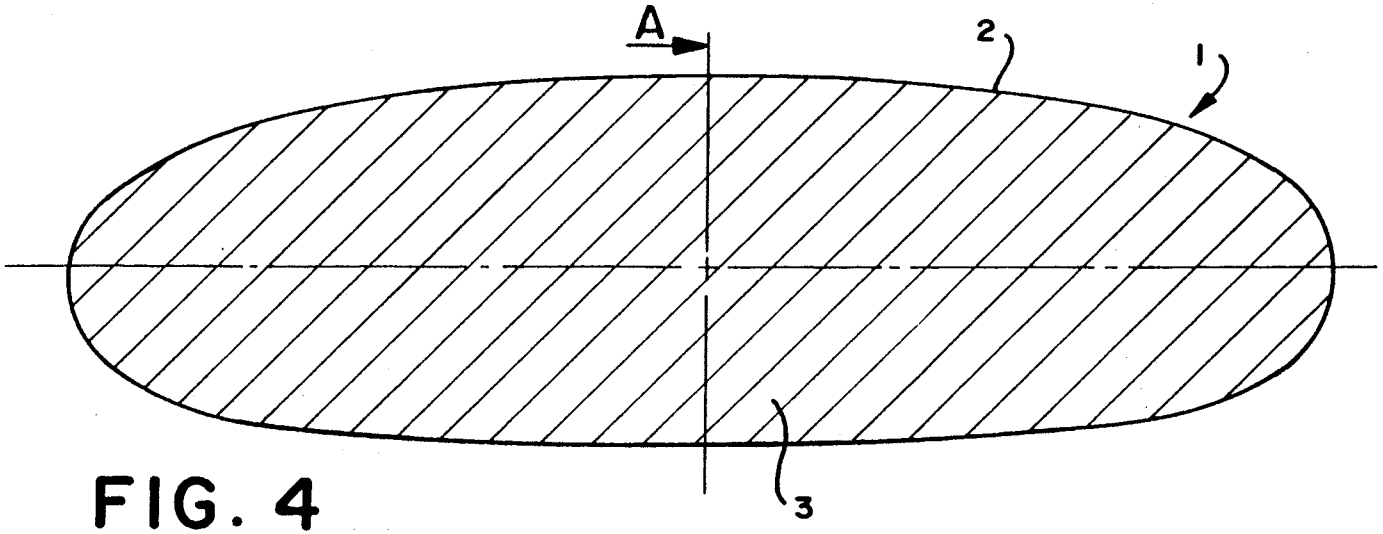
FIG. 4 shows a section through a filled, uncompressed pillow on the line B—B according to FIGS. 1 and 2.
Figure 5:
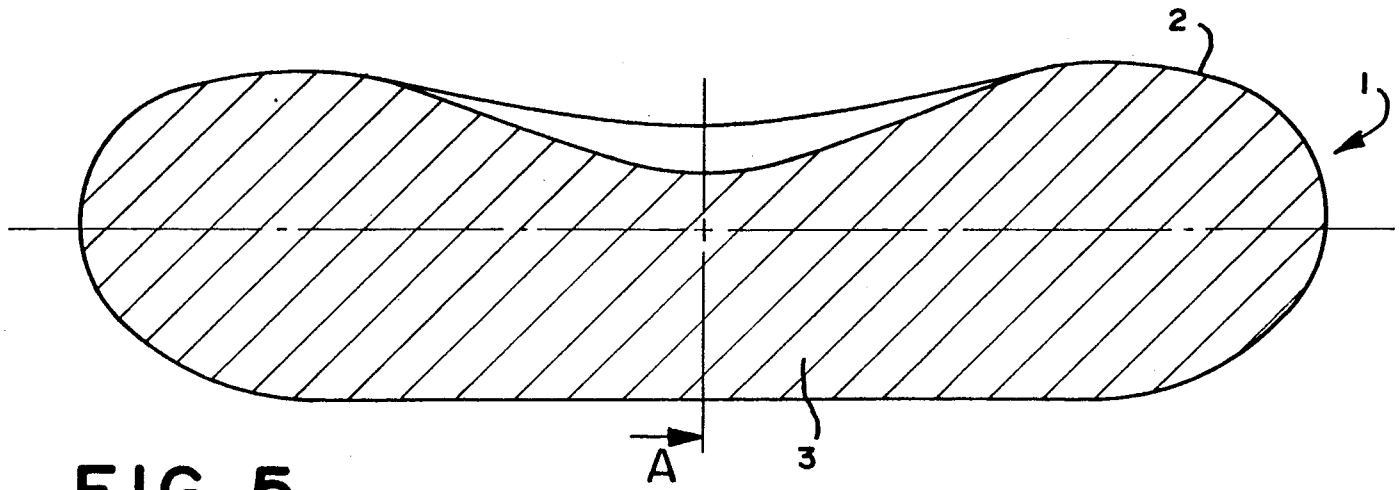
FIG. 5 shows a section through a filled, compressed pillow on the line B—B according to FIGS. 1 and 3.

FIGS. 2 and 4 show the pillow 1 in the uncompressed state, while FIGS. 3 and 5 show the state of the pillow 1 compressed by a head (not shown) resting on it. It is clearly seen that the pillow slightly bulges adjacent to the area directly compressed and is lying flat underneath. In the area of the inward curve 4 of the cover 2, the pillow 1 is compressed more than in the opposite area, which is the result of the fact that here the neck is also supported.

In particular, in the lateral position and when this is desired for shorter or longer periods of time, the pillow may also be set on edge, i.e., with the outward curvature 5 directed downward, whereupon the head comes to rest in the inwardly directed curvature 4. The two rounded "corners" adjacent to the inwardly directed curvature 4 then additionally support the head on the side, while parts of the pillow do not extend too far into the face of the sleeper. This is especially recommended for larger and/or heavier persons, who do not wish to place their head too high or support it too hard in the supine position. The configuration of the pillow 1 here again provides a very good head support.

Particularly if synthetic fibers are used as the basis of the filler material, the entire pillow may be washed and therefore it is not absolutely necessary to provide a pillow case. Such a case may be used, but it should fit relatively tightly over the pillow so that there will be no folds in the case to interfere with sleeping comfort.

I claim:

1. A pillow comprising:

a cover made from an essentially unstretchable fabric, said cover being formed from two halves joined together about their peripheries, each of said halves including a pair of opposing, outwardly curved lateral sides, a first longitudinal side and a second outwardly curved longitudinal side, each of said lateral sides being joined with outwardly rounded corners to said longitudinal sides, said first longitudinal side being longer than said second longitudinal side and includes a centrally located, inwardly directed curved portion extending over a substantial length thereof; and a filling formed from a spherically intertwined fiber aggregate, said fiber aggregate being compressed within said cover to a pile density of between 30 to 50 g/dm$^3$.

2. A pillow according to claim 1 wherein said fiber aggregate has an uncompressed, loose density and is compressed within said cover corresponding to 3 to 7 times said loose density.

3. A pillow according to claim 2 wherein the largest lateral side length is 30 to 50 cm.

4. A pillow according to claim 3 wherein the cover has a fill volume of 5 to 9 dm$^3$.

5. A pillow according to claim 2 wherein the narrowest width of the cover is centered and amounts to approximately $\frac{2}{3}$ of the greatest length of the cover.

6. A pillow according to claim 2 wherein the radius of the inwardly directed curvature of the first longitudinal side of the cover corresponds to 3/10 to 4/10 of the greatest length of the cover.

7. A pillow according to claim 2 wherein the radius of the outwardly directed curvature of the second longitudinal side of the cover in the summit of said curvature corresponds to 3/10 to 4/10 of the greatest length of the cover.

8. A pillow according to claim 7 wherein the radius of the outwardly directed curvature of the second longitudinal side of the cover is larger in the summit of said curvature than the greatest length of said cover and is at least twice as large as the largest width of the cover.

9. A pillow according to claim 2 wherein the radius of the rounded corners of the cover between the inwardly curved first longitudinal side and each of said lateral sides of the cover corresponds to between 1/10 and 1/20 of the greatest length of the pillow.

10. A pillow according to claim 2 wherein the radius of the rounded corners of the cover retain the outwardly curved second longitudinal side and each of said lateral sides of the cover is between $\frac{1}{4}$ and 166 of the greatest length of the pillow.

11. A pillow according to claim 2 wherein the cover comprises a cotton fabric.

12. A pillow according to claim 2 wherein the fabric used for the cover has a specific weight of 100 to 150 g/m$^2$.

13. A pillow according to claim 2 wherein the two halves of the cover are sewn together about their peripheral edges.

14. A pillow according to claim 13 wherein a closeable opening such as zipper or the like is located in the seam joining together the two halves in the area of the outwardly directed curvature of the second longitudinal side.

15. A pillow according to claim 14 wherein said closeable opening has a length of approximately 30 cm.

16. A pillow according to claim 2 wherein the density of the individual, uncompressed fiber aggregates prior to their filling into the cover is between 0.03 and 0.06 g/cm$^3$.

17. A pillow according to claim 2 wherein the mean diameter of the individual fiber aggregates is between 3 and 7 mm.

* * * * *